United States Patent [19]

Feklin et al.

[11] Patent Number: 4,458,765

[45] Date of Patent: Jul. 10, 1984

[54] TOOL FOR FORMING A HOLE IN MACROPOROUS COMPRESSIBLE SOIL

[75] Inventors: Valentin I. Feklin; Anatoly N. Mironenko; Sergei V. Shatov; Ninel S. Shvets; Jury A. Kirichek, all of Dnepropetrovsk, U.S.S.R.

[73] Assignee: Dnepropetrovsky Inzhenerno-Stroitelny Institut, Dnepropetrovsk, U.S.S.R.

[21] Appl. No.: 377,684

[22] Filed: May 12, 1982

[51] Int. Cl.[3] ..... E21B 7/26

[52] U.S. Cl. ..... 175/19; 175/21; 175/394

[58] Field of Search ..... 175/19, 21, 394, 395, 175/55, 52, 388; 166/285–287; 405/236, 240, 241, 243, 133; 52/157

[56] References Cited

U.S. PATENT DOCUMENTS

| | | | |
|---|---|---|---|
| 2,229,912 | 1/1941 | Baily | 175/21 |
| 3,309,877 | 3/1967 | Degen | 175/55 |
| 3,447,616 | 6/1969 | Granat | 175/394 |
| 3,512,365 | 5/1970 | Muller | 405/243 X |
| 4,031,708 | 6/1977 | Hanson | 405/133 |
| 4,111,270 | 9/1978 | Fischer et al. | 175/394 X |
| 4,193,461 | 3/1980 | Lamberton et al. | 175/19 |

*Primary Examiner*—Ernest R. Purser
*Assistant Examiner*—Thuy M. Bui
*Attorney, Agent, or Firm*—Burgess, Ryan and Wayne

[57] ABSTRACT

A tool comprises a body having coaxial portions radially defined by soil compaction surfaces of step-down radii from the sizing portion to the tool tip. The soil-compaction surface of each portion is a cylindrical surface generated by a generatrix of a predetermined length extending parallel to the tool axis and bounded by two parallel helices of one and the same helix angle. These surfaces are successively conjugated by transition portions defined by a cylindrical surface whose generatrix is parallel to the tool axis and uniformly approaches the same axis to thereby form a smooth transition from the surface of the body portion of a greater radius to that of an adjacent body portion of a smaller radius. A method of forming a hole by the same tool is also described.

9 Claims, 33 Drawing Figures

TOOL FOR FORMING A HOLE IN MACROPOROUS COMPRESSIBLE SOIL

BACKGROUND OF THE INVENTION

1. Field of the Invention

The present invention relates to a tool for forming a hole in macroporous compressible soil and to a method of forming a hole by the same tool.

The invention may be utilized while forming holes in the soil specified for cast-in-place piles in industrial and civil engineering practice.

For the purpose of the present invention by "macroporous compressible soil" is meant loess, water-saturated sandy soil, soft water-saturated clay soil with a consistency index $I_L \geqq 0.3$ and other similar kinds of soil.

Such soil is known for its low structural strength, it easily collapses in contact with water and under dynamic load.

Conventional methods of forming holes in soil such as percussion and rotary drilling, washboring as well as tools for practicing such methods are practically of low efficiency for the soil specified. Thus, for example, the percussion drilling destroys the wall of a hole. Combined methods of percussion drilling and vibratory action, apart from the abovementioned disadvantage, has an effect on nearby buildings and produces noise. Since the percussion tools operate by a sequence of pulses their efficiency is limited. The method of rotary drilling does not provide for an adequate compaction of the wall of the hole. Therefore such walls have an inferior performance characteristics, which in turn results in a lower carrying capacity of the pile. The washboring of a hole in the soil specified is inappropriate in general.

Furthermore, conventional methods of forming holes singly or in combination to a greater or lesser degree involve soil excavation but this is not known to be any help in compacting the wall of the hole.

2. Description of the Prior Art

Known in the art are a tool and method of forming a hole in macroporous compressible soil (U.S. Pat. No. 4,193,461). The tool comprises a body adapted to be connected to a boring rod and having a sizing part and coaxial body portions radially defined by soil compaction surfaces and of step-down radii from the sizing part to the tool tip.

Each body portion is constructed as a ram assembly comprising one or more ram shoes radially movable from a retracted position to an extended position. As the tool is driven into soil each body portion circumferentially compacts the soil to the radial extent which is equal to or slightly greater than the radius of an adjacent body portion in the direction from the tool tip to the sizing part when the ram shoe or shoes are in the retracted position. In such a manner the hole is formed simultaneously with the soil compaction operation.

The prior art tool provides for soil compaction by a discontinuous radial action on the soil with the ram shoes in zones corresponding to the body portions. Therefore a nonuniform compaction of the soil both circumferentially of the hole and along its length is the result which has an effect on the carrying capacity of the pile. Such a discontinuous action on the soil, which offers an increased resistance to such action as it is compacted, is by the reciprocating ram shoes. Such a construction of the tool as well as the method of acting on the soil are limited as to efficiency and are characterized by an increased consumption of power, since the ram shoes are to be retracted prior to effecting the next power stroke.

SUMMARY OF THE INVENTION

An object of the invention is to provide a more efficient tool for forming a hole in macroporous compressible soil.

Another object of the invention is to provide a tool for forming a hole in macroporous compressible soil—a tool of a lower power consumption than the prior art tools.

A further object of the invention is to provide a tool for forming a hole in macroporous compressible soil, which makes possible a uniform compaction of the wall of the hole both circumferentially and along the hole length.

A still further object of the invention is to provide a method of forming a hole in macroporous compressible soil, enabling a continuous and uniform compacting of the wall of the hole with the tool of the invention to improve hole forming operations.

It is also an object of the invention to provide a tool for and a method of forming a hole, which make it possible to increase the carrying capacity of the cast-in-place piles.

Yet it is a still further object of the invention to provide a method of forming a hole with the tool of the invention, which method and tool make possible consolidating the wall of the hole with a suitable hardenable composition.

These and other objects of the invention are attained by that there is provided a tool for forming a hole in macroporous compressible soil, comprising a body adapted to be connected to a boring rod and having a sizing part and coaxial body portions radially defined by soil compaction surfaces and of step-down radii from the sizing part to the tool tip, wherein, according to the invention, the soil compaction surface of each body portion is a cylindrical surface generated by a generatrix of a predetermined length extending parallel to the tool axis and bounded by two parallel helices of one and the same helix angle, these surfaces being successively conjugated by transition portions defined by a cylindrical surface whose generatrix is parallel to the tool axis and uniformly approaches this same axis to thereby form a smooth transition from the surface of the body portion of a greater radius to that of an adjacent body portion of a smaller radius.

Such tool is simple in construction and reliable in operation since there are no parts movable in respect to each other. A smooth transition from one body portion to another provides for a continuous radial action on the soil to increase efficiency in hole forming. The tool is noiseless in operation and does not produce any impact load on the soil and, consequently, on the nearby buildings, which is an advantage when the tool is used in densely-populated areas. Since there is no impact load on the soil, the wall of the hole is compacted more uniformely.

In the tool of the present invention the adjacent transition portions are displaced in relation to each other along the cylindrical helix by an angular value not greater than 720°. Such a tool has no radial run-out, i.e. the tool body is uniformly loaded.

It is preferred that the cylindrical surfaces adjacent the steps provided between the body portions having step-down radii and the transition portions have ridge members disposed along the helix, each ridge member having a radial extent not exceeding that of the step of an adjacent body portion of a greater radius. These ridge members additionally force the soil radially. Also, they stabilize axial movement of the tool in the soil.

It is further preferred that each transition portion be a roller rotatable about an axle disposed angularly to the tool axis, the angle of the roller disposition being equal to the helix angle of the helices bounding the cylindrical surfaces of the adjacent body portions so that each helix extends in the plane of a corresponding end face of the roller.

Such a modified tool makes it possible to form a hole having a compacted wall, which improves load-carrying capacity of cast-in-place piles. The rollers take the function of radially compacting the soil to reduce friction by 3 to 3.5 times, since sliding friction on metal is replaced by rolling friction.

It is further preferred that the body has an axial cavity tapering towards the tip and a vibrator for causing lateral vibrations, mounted in said cavity and including a rotary drive, a shaft connected to the drive and extending substantially axially of the tool, and unbalanced mass member mounted on the shaft along its length and having different mass value diminishing in the direction of the taper of the cavity in the body.

Such a tool enables forming holes of a large diameter (more than 0.8 m) due to an additional vibratory action on the soil.

It is further preferred that support members for the shaft be provided between the unbalanced mass members whereby vibratory action of each unbalanced mass member on the soil is localized.

It is further preferred that the tool body comprises coaxial body portions of step-down radii from the sizing portion towards the location of the boring rod attachment, the step-down portions being radially defined by cylindrical surfaces, generated by the generatrix of a predetermined length extending parallel to the tool axis and bounded by two parallel helices of one and the same helix angle and these surface being successively conjugated by transition portions defined by a cylindrical surface whose generatrix is parallel to the tool axis and is uniformly approaching this same axis to thereby form a smooth transition from the surface of the body portion of a greater radius to that of an adjacent body portion of a smaller radius.

The above modification of the tool is useful for consolidating the wall of a hole with various consolidating materials while driving the tool into soil as well as withdrawing it therefrom and provides for a desired strength and thickness of the consolidated well area, and further makes possible a higher load-carrying capacity of cast-in-place piles and lower labor input.

Possible is such a modification of the tool, wherein there is a further body coaxial with the body and having an axial bore for conducting a hardenable fluid, as well as a sizing part and coaxial portions being radially defined by cylindrical surfaces generated by generatrix of a predetermined length extending parallel to the tool axis and bounded by two parallel helices of one and the same helix angle and these surfaces being successively conjugated by transition portions defined by a cylindrical surface whose generatrix is parallel to the tool axis and is uniformly approaching the same axis to thereby form a smooth transition from the surface of the body portion of a greater radius to that of an adjacent body portion of a smaller radius, at one side the further body is rigidly connected by means of a hollow connector communicating with the axial bore for conducting a hardenable fluid and having openings for the hardenable fluid flowing into the hole, and at the other side the body has a portion for attaching the tubular boring rod through which the hardenable fluid may pass to the bore in the body and further on through the opening into the hole.

This modification is suitable for forming holes and solidifying their walls simultaneously with driving the tool in and withdrawing it from the soil, which makes the labor input lower and efficiency higher. As a result, wall stability is improved with a consequent improvement in the load-carrying capacity of cast-in-place piles and in the reliability of development wells. Furthermore, such arrangement provides for forcing a consolidating material into the wall of a hole to form one or several layers of one or several various materials.

Possible is such a modification of the tool, wherein the body comprises at least two parts of which the first part is attached with its side having a greater radius to the tubular boring rod and has a through axial bore while on the side having a smaller radius this part has an end face similar to the step provided between adjacent body portions, and the second part is received in the axial bore for conducting a hardenable fluid, the first part having longitudinal grooves provided in the wall of the axial bore and the second part having projections provided on the outside thereof and received in the longitudinal grooves for sliding therealong so that when the tool is being driven into the soil, the second part retracts into the first part, and the outlet openings are closed with the first part of the body, whereas the second part extends from the first part when the tool is being withdrawn from the hole and the outlet openings become open, whereby the hardenable fluid may flow therefrom to form a pile.

This modification may be used for forming a hole and concreting a pile without a change of equipment and without a casing pipe to protect the hole made in soft soil with a consequent improvement in labor productivity.

Possible in still another modification of the tool, wherein there is provided a third part of the body which is similar to the first part but reversed, slipped over the tubular boring rod for sliding motion therealong and having a portion of a greater radius serving as the sizing part and provided with a skirt extending towards the first part and having an end face similar to the step between adjacent portions, there being a radial surface having an engaging means where the first part is attached to the boring rod and the third part has an opposite surface having a corresponding engaging means, whereby turning of the third part with respect to the first part and the second part is prevented when the tool is being withdrawn from the hole, the skirt sufficiently extending in the axial direction so as to provide an enclosed fluid discharge zone for the fluid flowing from the outlet openings in the second part as the tool is being withdrawn from the hole, while a stop is provided on the boring rod for limiting the motion of the third part along the boring rod as the tool is being driven into the soil, thereby setting the end face of the skirt on a respective helix.

When the tool according to the above modification is being withdrawn from the hole formed while a concrete mixture is being fed to form a pile, the soil that may fall is prevented from intermixing with the concrete mixture.

The invention also provides a method of forming holes in macroporous compressible soil consisting in driving a tool into the soil, consolidating the wall of the hole, and withdrawing the tool from the hole. According to the invention, the wall of the hole is consolidated, simultaneously with the step of driving in the tool of the present invention, by continuously applying radial forces per zone of contact of the tool with the soil continuously and circumferentially of the hole being formed to widen the hole to a predetermined diameter and to compact the soil as the tool is being driven in.

This modification of the method provides for a continuous compaction of the soil as the tool is being driven in or the hole formed, which results in an improved compact wall of the hole.

It is preferred that at first a pilot hole of a diameter less than a predetermined one is formed with a conventional tool and by a conventional method and then this hole is filled with a consolidating material and a hole of a predetermined diameter is formed with the tool of the invention driven in along the axis of the pilot hole to press the consolidating material into the soil.

Such a modification of the method enables formation of a hole and simultaneous solidification of its wall with a hardenable material to improve the load-carrying capacity of the cast-in-place piles and to make development wells more reliable.

The pilot hole may be filled with a consolidating material up to the level of from 1 to 1.5 m below the mouth of the hole.

It is expedient that the ratio of the diameter of the pilot hole to the diameter of the hole to be formed is in the range of 0.4 to 0.8.

Such conditions make it possible to prevent forcing the hardening material from the mouth of the hole as the tool is being driven into the pilot hole.

The method may be practiced by using a tool further comprising, apart from the main soil compaction part, an additional soil compaction part including similar coaxial portions of the radii diminishing in a steplike fashion from the sizing part to the location where the boring rod is attached to the tool.

In accordance with this modification of the tool the method can be carried out in the following manner: first, the tool is driven into the soil to a predetermined depth, whereupon a consolidating material is fed into the obtained hole and the tool is withdrawn from the hole to press the consolidating material into the wall of the hole. This modification of the method makes it possible to consolidate the wall of the hole both while driving the tool into the soil and while withdrawing it therefrom.

Depending on the material used and the length of the hole the consolidating material may be fed batchwise. This makes it possible to substantially decrease the consumption of the consolidating material and to control a load upon the tool in a desirable manner.

While carrying out the method in accordance with the above modification of the tool the latter can be driven into the soil with simultaneous feeding of the consolidating material and after driving the tool to a predetermined depth the tool is withdrawn from the hole to press the consolidating material into the wall of the hole.

The method can be also carried out with the aid of a tool comprising two coaxially mounted bodies similar to that which is used when carrying out the modification of the method described above. One of these bodies has a tip, and the other is connected to a hollow boring rod and has a through axial bore. These bodies are connected by a hollow connector communicating with the axial bore and having openings for a consolidating material to be fed into the hole. When carrying out the method according to this modification of the tool the latter is driven into the soil to a predetermined depth with simultaneous feeding of the consolidating material and with pressing this same material into the wall of the hole, whereupon the tool is withdrawn from the hole.

When carrying out such a modification of the method it is possible to additionally feed a consolidating material into the hole while the tool is being withdrawn therefrom with simultaneous pressing of this material into the wall of the hole to thereby form a further consolidating layer.

The above-mentioned and other objects and advantages of the invention will become apparent from the following description of the embodiments thereof with reference to the accompanying drawings in which the same parts are designated by the same reference numerals and in which:

FIG. 1 generally shows a tool according to the invention;

Figure 12:
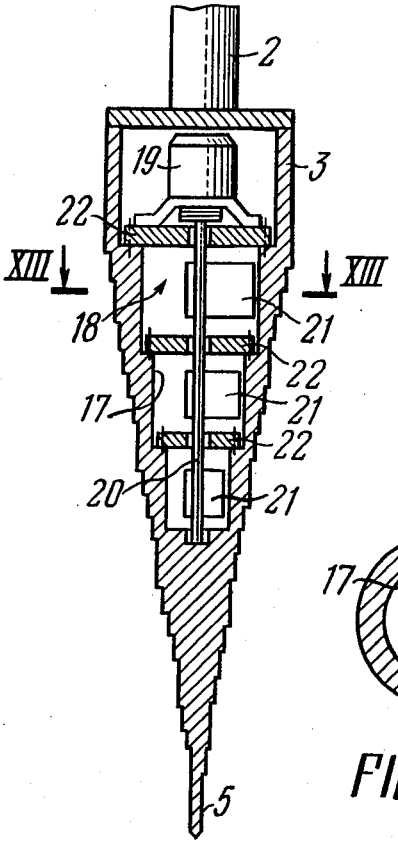
Figure 13:
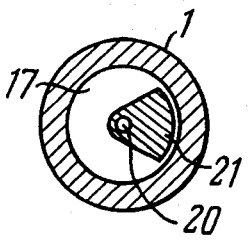
Figure 14:
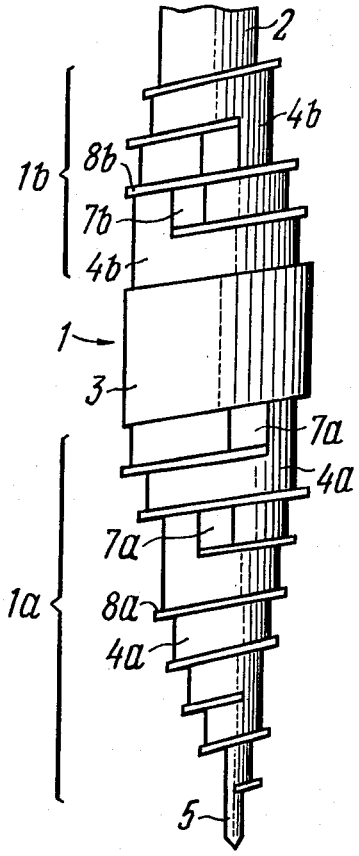
Figure 16:
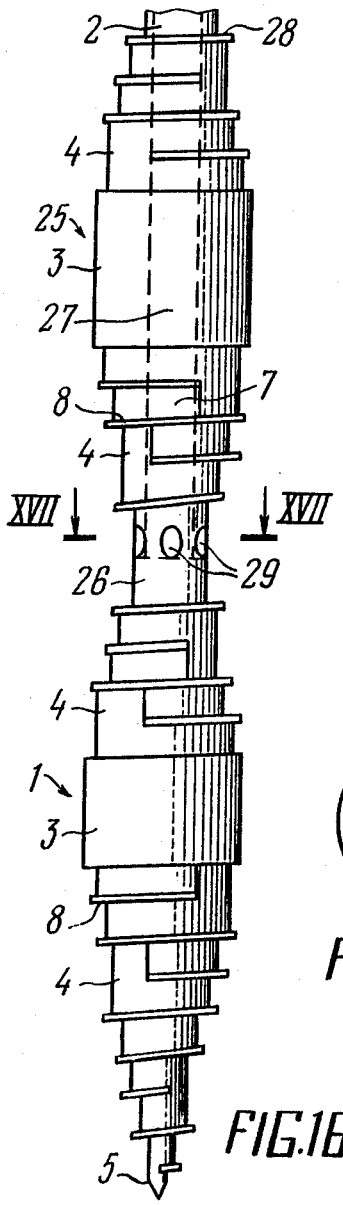
Figure 17:
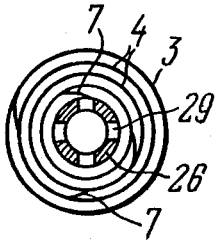
Figure 18A:
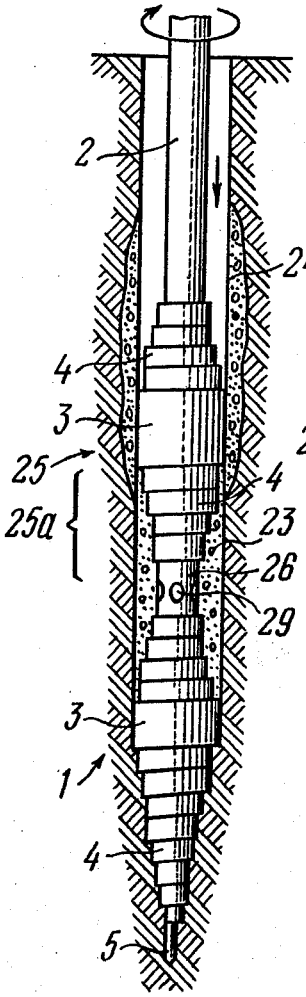
Figure 19:
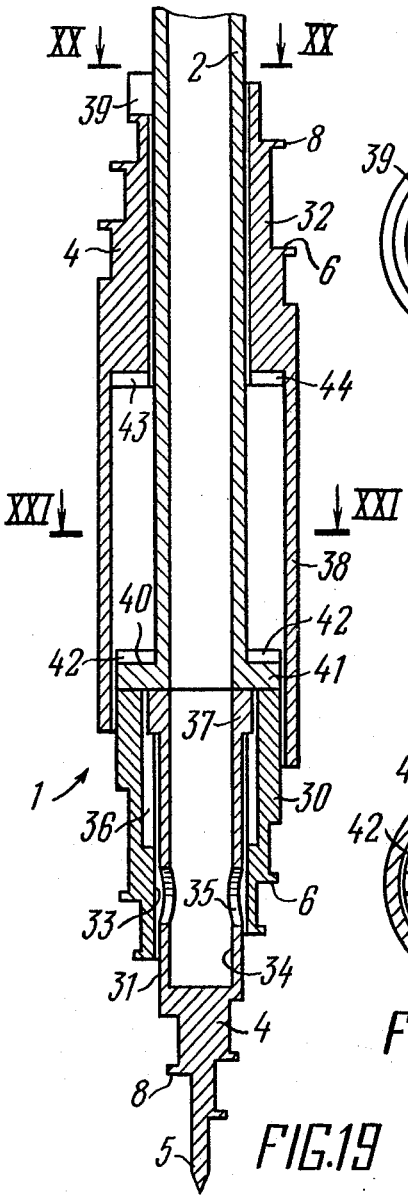
Figure 20:
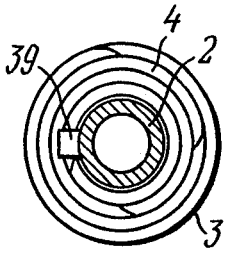
Figure 21:
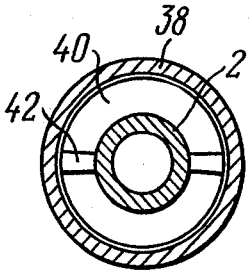
Figure 22:
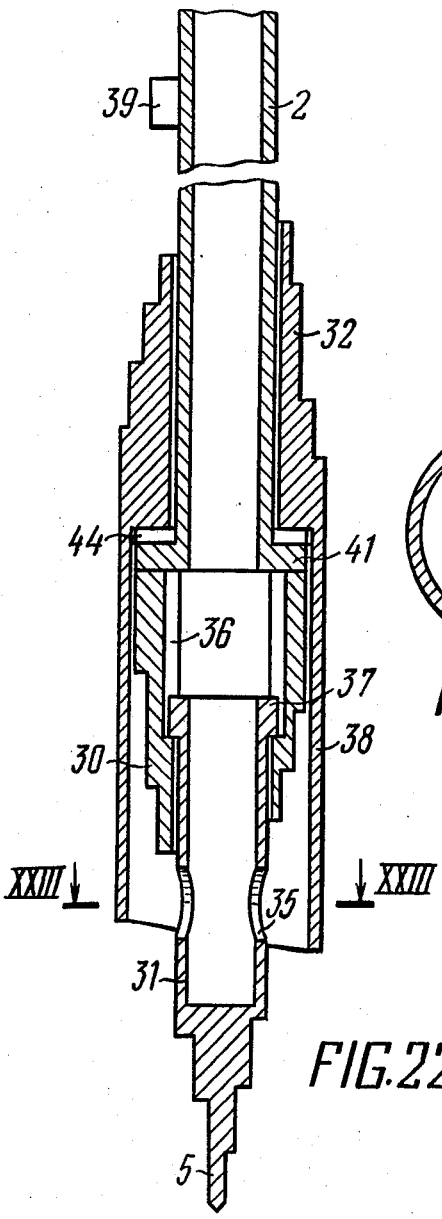
Figure 23:
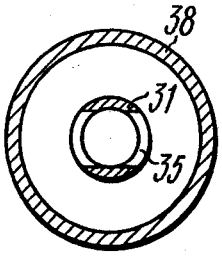
Figure 24A:
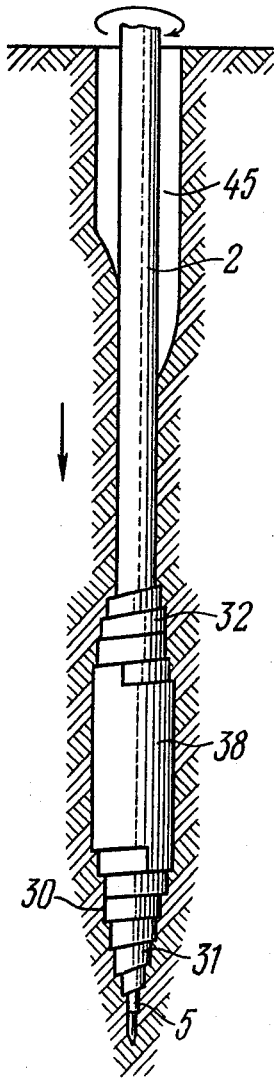
Figure 24B:
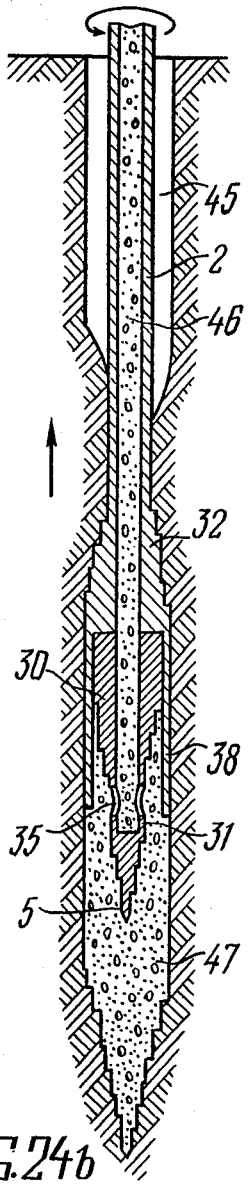

FIGS. 11, *a* through *e*, is a diagrammatic representation of an alternative way of practicing the method according to the invention;

FIG. 12 is an alternative construction of the tool according to the invention;

FIG. 13 is a sectional view taken on line XIII-XIII in FIG. 12;

FIG. 14 is a modified form of the tool of the invention, the tool being provided with a reversed soil compaction part;

FIGS. 15, *a* through *d*, is a diagrammatic representation of an alternative way of practicing the method according to the invention;

FIG. 16 is yet another modified form of the tool having two coaxial bodies;

FIG. 17 is a sectional view in line XVII—XVII in FIG. 16;

FIGS. 18, *a* and *b*, is a diagrammatic representation of an alternative way of practicing the method according to the invention;

FIG. 19 is a view in axial section of a modified form of the tool of the invention, the tool parts being shown in the position, which they assume when the tool is driven in;

FIG. 20 is a sectional view on line XX—XX in FIG. 19;

FIG. 21 is a sectional view on line XXI—XXI in FIG. 19;

FIG. 22 is a view in axial section of the tool shown in FIG. 19, the tool parts being shown in the position, which they assume when the tool is withdrawn;

FIG. 23 is a sectional view on line XXIII—XXIII in FIG. 22;

FIGS. 24, *a* and *b*, is a diagrammatic representation of operation of the tool shown in two positions in FIGS. 19 and 22.

DESCRIPTION OF THE PREFERRED EMBODIMENTS OF THE INVENTION

Figure 1:
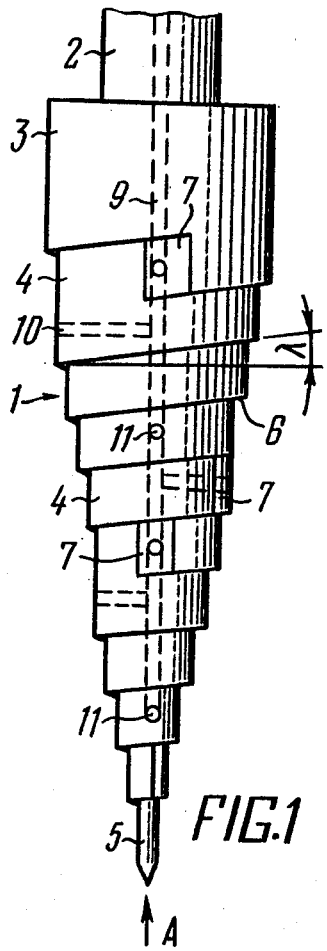

Referring to FIG. 1, a tool for forming a hole comprises a body 1 adapted to be connected to a boring rod 2. The body 1 has a sizing part 3 and coaxial body portions 4 forming soil compacting part of the tool.

Figure 3:
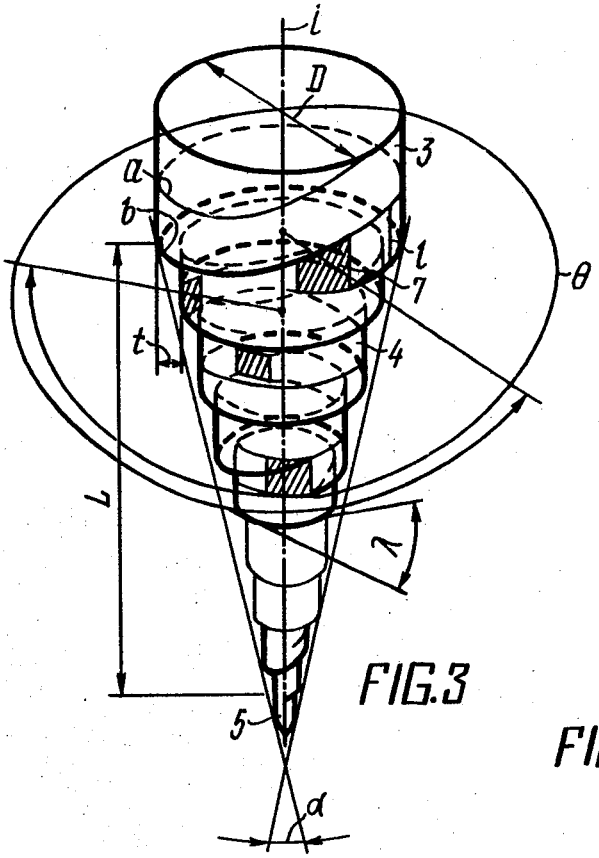
FIG. 3 is a geometrical construction of the tool according to the invention.

Each body portion 4 is of its proper radius r and all the body portions are such that the radius of an adjacent body portion in the direction from the sizing part 3 to the tip 5 is shorter than that of the previous body portion. Also, each body portion 4 is radially defined by a soil compacting surface. This surface is a cylindrical surface (FIG. 3) generated by a generatrix 1 of a predetermined length, parallel to the tool axis i and bounded by two parallel helices a and b of the same helix angle λ so that the soil compaction part of the body 1 has a cone-like form composed of the body portions 4 radially defined by cylindrical surfaces of step-down radii from the sizing part 3 to the tool tip 5.

Figure 5:
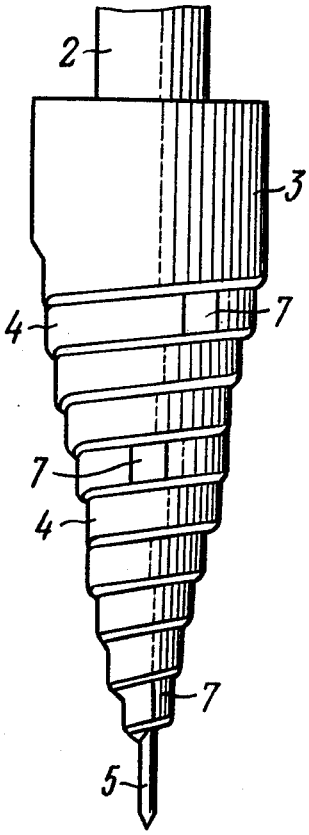
FIG. 5 is a further modification of the tool according to the invention.
Figure 6:
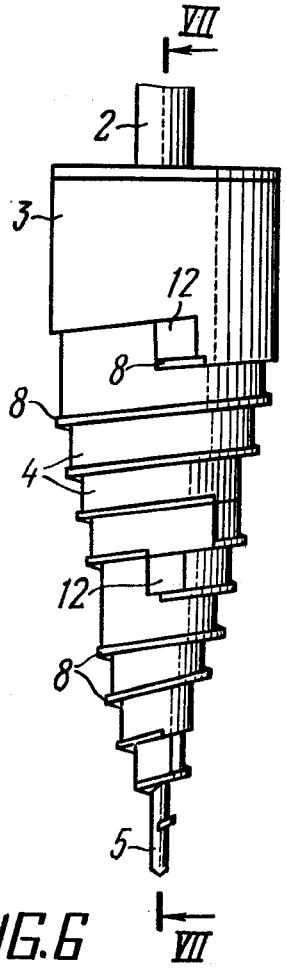
FIG. 6 is an alternative modification of the tool according to the invention.
Figure 7:
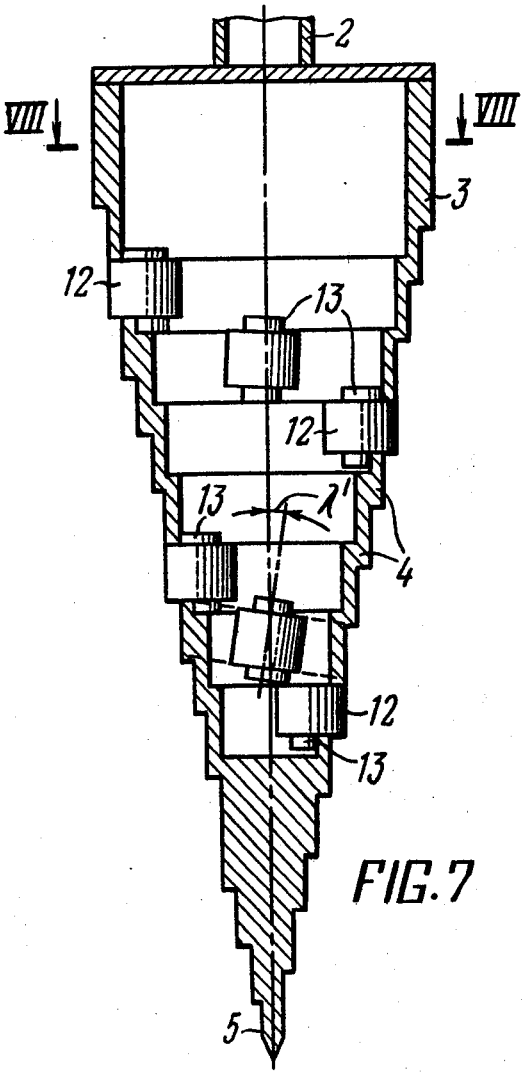
FIG. 7 is a view in axial section of the tool of FIG. 6.

Since the axially arranged body portions 4 have unequal radii, a step 6 is provided between them or their cylindrical surfaces, which step is shown, for the sake of simplicity, as a shoulder (FIG. 1) though it may have rounded off corners as can be seen in FIG. 5. Cylindrical surfaces of the axial body portions 4 are successively conjugated by transition portions 7 (FIGS. 1 and 2) defined by a cylindrical surface whose generatrix has a length equal to that of the generatrix 1, is parallel to the tool axis i and uniformly approaches this same axis to thereby form a smooth transition from the cylindrical surface of the body portion 4 of a greater radius to that of the adjacent body portion 4 of a smaller radius.

Figure 2:
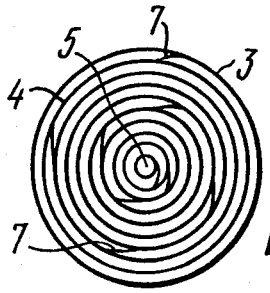
FIG. 2 is a view, looking in the direction of arrow A in FIG. 1.

As can be seen from FIG. 1 and particularly FIG. 2, each adjacent transition 7 is displaced in relation to each other along the cylindrical helix by an angular value not greater than 720° C., i.e. the angular displacement $\theta$ of the transition portions 7 or the length of the coaxial portion 4 along a helix, such as the helix a should not exceed 720°, because if it does, the portion 4 will become a cylindrical body working as a sizing part which does not participate either in widening the hole to a predetermined diameter or in compaction of soil, which will become apparent from the description of the operation of the tool according to the invention.

Figure 4:
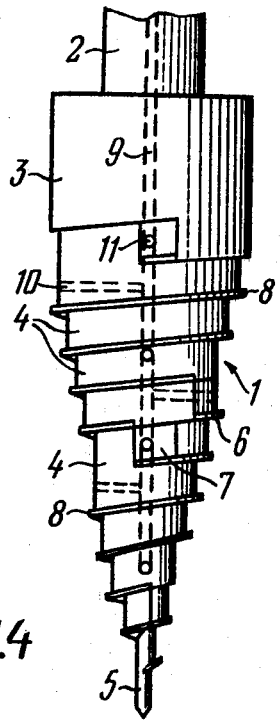
FIG. 4 is a modification of the tool according to the invention.

As can be seen from FIG. 4, the cylindrical surfaces of the portions 4 adjacent the steps 6 as well as the transition portion 7 are provided with ridge members 8 disposed along the helix, each ridge member 8 having a radial extent not exceeding that of the step 6 of an adjacent body portion 4 of a greater radius. Such radial sizes of the ridge members are selected to prevent the wall of the hole from collapse in the course of the formation thereof.

As can be seen from the accompanying drawings, the tool according to the invention has an axial bore 9 and laterals 10 connected with a source of liquid, such as water (not shown). Through the axial bore 9 and the laterals 10, a liquid may be supplied if necessary (for instance, the soil is very dense) in an amount sufficient to reduce the load upon the tool without soil destruction.

The tool according to the invention was described above in such a way as to make those skilled in the art understand it. Specific construction characteristics such as sizes, can be readily implemented by employing conventional materials and conventional methods of construction, taking into account specific conditions and the purpose of the tool.

Given below are but several Examples of determination of sizes of the tool according to the invention. Experimental check of the tool of the invention has shown that the tool taper should be within the range of 15 to 40°, the most efficient range being from 20° to 30°. The number of portions 4 is within the range of 5 to 20, the most advisable number being from 10 to 15.

EXAMPLE 1

With the diameter of the hole being D=600 mm, taper $\alpha=25°$ and angular displacement $\theta=450°$ it is necessary to determine:

value of the step, t, minimum size along the axis of the portion of one radius, l, radius of each coaxial portion of the body from the sizing part to the tip, $r_1, r_2 \ldots r_n$.

Assume that n=10, R=½D.

Then:

$$t = \frac{R}{n} = \frac{300}{10} \; 30 \text{ mm};$$

$$l = \frac{360\,R}{n\theta tg\alpha/2} = \frac{360\;300}{10\;450\;0\;22} = 109 \text{ mm};$$

$$r_1 = R - t = 300 - 30 = 270 \text{ mm};$$

$$r_2 = R - 2t = 300 - 60 = 240 \text{ mm and so on.}$$

The length of the tool or the soil compaction portion thereof can be determined by the following formula:

$$L = l_1 \frac{1}{360} + l_2 \frac{2}{360} + \ldots l_n \frac{Q_n}{360} \sum_{i=n}^{i=n} l_l \frac{i}{360} \qquad (1)$$

where $1_1, 1_2 \ldots 1_n$ is a pitch of a cylindrical helix or the minimum axial size, this same is a length of the generatrix of the cylindrical surface of axial portions of the body from 1 to n, $\theta_1, \theta_2 \ldots \theta_n$ is angular displacement of transition portions from i to n, ($\theta/360$) is the number of turns, N, of the helix within the range of one portion of the body.

If $1_1=1_2=1_n$=const., and $\theta_1-\theta_2= \ldots \theta_n$=const., i.e. if the values 1 and 0 are equal for all the portions, the length of the tool may be determined by the following formula:

$$L = nl\frac{\theta}{360} = nlN, \qquad (2)$$

where n is the number of the coaxial body portions. Note: the angular displacement of the transition portions is determined from the middle portion of one transition portion to the middle portion of the next transition portion.

EXAMPLE 2

The soil compaction portion, L, is to be determined if $n=10$; $1=70$ mm; $\theta=450°$.

Use is made of the formular (2) wherefrom $L=10\times70\times(450/360)=875$ mm.

EXAMPLE 3

The soil compaction portion, L, is to be determined if $n=12$; $1=80$ mm; $\theta=420°$.

Use is made of the formula (2) wherefrom $L=12\times80\times(420/360)=1120$ mm.

The tool according to the invention operates in the following manner.

On the surface of soil there is installed a centering tip 5 at a point where a hole is to be made, and through the boring rod 2 the tool is rotated from a drive (not shown). Simultaneously therewith an axial pressure is applied to the tool under the action of the mass of the tool, boring rod, drive, additional load (or pressure feed). As a result of rotation and axial pressure the tool is driven in the soil is continuously compacted from the circumference of the hole being made by the transition portions 7. The cylindrical surfaces of the portions 4 do not participate in the soil compaction, which is carried out step by step, first by the portions disposed near the tip 5, i.e. by those surfaces which are closer in radial direction to the longitudinal axis of the tool. As the tool turns by the angular value of $\theta$, which is equal to the length of the cylindrical portion along the helix, the soil is compacted by the next transition section disposed one step higher from the tip 5 and so on. When the sizing part passes through soil, there is formed a hole of a required diameter.

The ridge members 8 act as screw blades and aid in the progressive movement of the tool into the soil and stabilize this movement. When driving the tool into highly compressible soils, such as clay soil, having a consistency index of $I_L>0.6$ the ridge members 8 are as a rule not required. The soil is not excavated as the hole is formed, it is gradually pressed into the wall of the hole. Thus a zone of compacted soil is formed around the hole. Due to compaction of soil around the hole the load carrying capacity of the cast-in-place piles increases and subsidence of soil is eliminated.

Figures 11A, 11B, 11C, 11D, 11E:
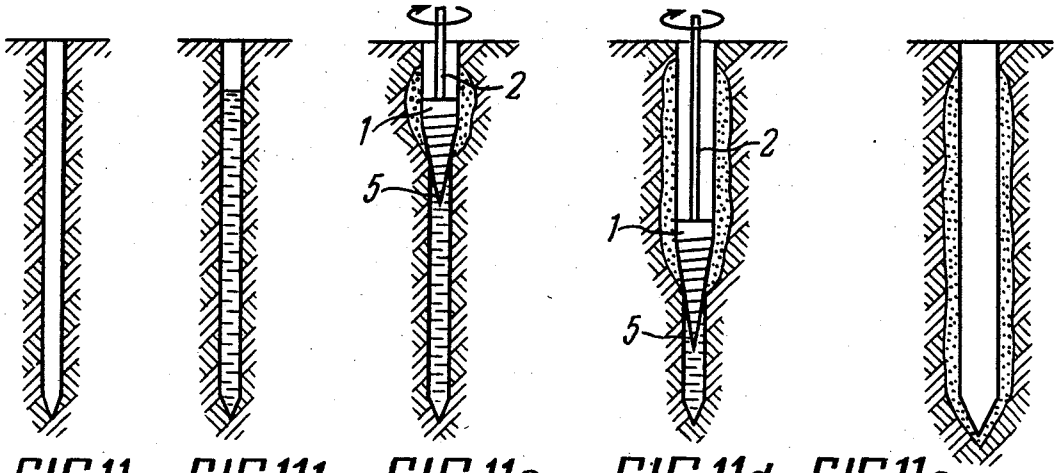

The tool according to the invention can be used for carrying out the method of forming a hole to be filled with a consolidating material. As can be seen from FIGS. 11, *a* through *e*, at first a pilot hole of a diameter less than a predetermined one is formed with a conventional tool, such as drill bit and then this hole is filled with a consolidating material (FIG. 11*b*). Then along the axis of the pilot hole the hole of a predetermined diameter is made by the tool according to the invention (FIGS. 11*c* and *d*) by pressing the consolidating material into the soil. The ready hole is illustrated in FIG. 11*e*.

Very suitable in operation is a modification of the tool, shown in FIGS. 6 to 10 of the drawings. According to this modification each said transition portion 7 (FIGS. 6 and 7) is formed by the roller 12 (FIGS. 6 and 7) mounted for rotation around its axle 13. The axle 13 of the roller 12 (FIG. 7) is disposed at an angle to the axis of the tool, is equal to the angle of the helices defining the cylindrical surfaces of coaxial portions 4 of the body 1. Each helix is disposed in the plane of a corresponding end face of the roller 12, as shown in dotted lines in FIG. 7.

Figure 8:
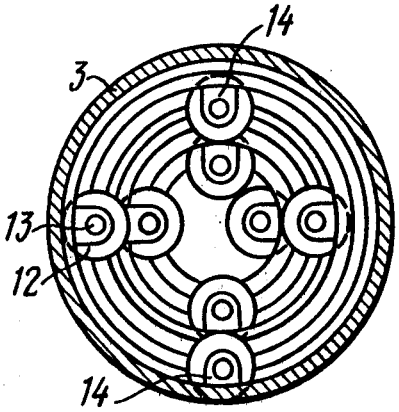
FIG. 8 is a sectional view taken on line VIII—VIII in FIG. 7.
Figure 10:
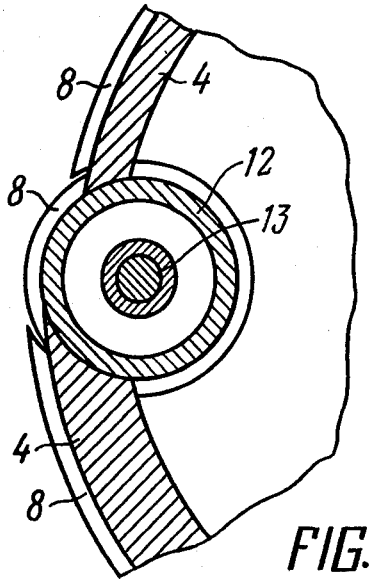
FIG. 10 is a sectional view taken on line X—X in FIG. 9.

The rollers are displaced in the cross-sectional plane of the tool (FIGS. 7 and 8) with respect to one another, in particular through 90°, and are mounted in the body 1 on brackets 14 (FIG. 8). Such being the case, the body 1 has openings, and the rollers are disposed in these openings so that there is formed a smooth transition from the cylindrical surface of greater diameter to the cylindrical surface of a smaller diameter as is best seen in FIG. 10.

The diameter of each of the rollers 12 should not exceed 0.5 of the diameter of the body 1 in the cross-section where a given roller is installed, and the length of the roller should correspond to the distance between helices of a given portion of the body 1. Each roller 12 (FIGS. 9 and 10) is provided with a ridge member 8 at the side of the lower (in the drawings) end face. This ridge member is intended to ensure smooth conjunction of the cylindrical surfaces of the rollers 12 and the portions 4 of the body 1. The above-described rollers aid in reducing friction when the tool is driven into soil, since these rollers, turning together with the body 1 and ensuring radial compaction of the soil, at the same time roll on the hole wall being formed, and thus the sliding friction which took place in previously described modification is substituted for rolling friction.

Figure 9:
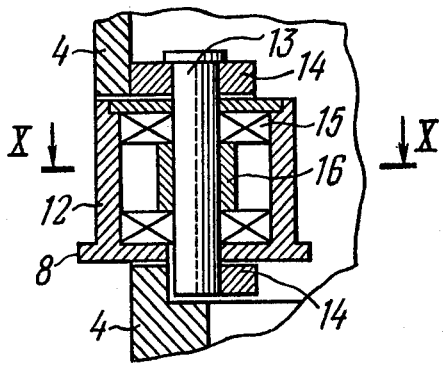
FIG. 9 is an enlarged detailed view of a transition portion of the tool constructed according to a modified form shown in FIG. 7.

It is to be noted that the rollers described herein may be variously constructed. In particular, they may be mounted on rolling bearings 15 between which there is disposed a sleeve 16 as shown in FIGS. 9 and 10. But it will be understood that there may also be used sliding bearings and other like parts.

It is also to be noted that the reduction in friction between the tool and soil due to the use of rollers aids in lowering power consumption and in enhancing the efficiency in operation.

Due to the rollers 12 the wall of the hole being formed becomes more compact, which upgrades the carrying capacity of the cast-in-place pile produced later on.

Where the efficiency of the tool is to be increased, as for instance in making holes of a large diameter (above 0.8 m), particularly in soil containing hard inclusions, it is expedient to use the modification illustrated in FIG. 12. In accordance with this modification, the body 1 has an axial cavity 17 tapering towards the tip 5. The tool is provided with a vibrator 18 for causing lateral vibrations, mounted in said cavity 17.

The above vibrator 18 includes a rotary drive 19 mounted in the upper (in the drawing) portion of the body 1, a shaft 20 connected with this drive and extending substantially axially of the tool, and unbalanced mass members 21. These unbalanced mass members are mounted on the shaft along its length and have different mass value diminishing in the direction of the taper of the cavity 17 in the body 1. Such distribution of the mass value of the unbalanced mass members 21 is due to the fact that with an increase of the cross-section of the hole the resistance of the soil to the tool being driven in increases, which requires large forces to overcome this resistance.

In operation, the rotation of the shaft 20 with unbalanced mass members 21 causes transverse vibrations of the body 1 and thereby the tool screws into soil. In so doing, the resistance of the soil is substantially reduced and the compaction of the latter improves. In addition, such way of driving the tool into soil precludes the effect of vacuum suction usual in such cases, which decreases the force and time required for withdrawing the tool from the hole.

With the above modification, it is advisable that the tool have several support members 22 for the shaft 20, provided between the unbalanced mass members 21 as shown in FIGS. 12 and 13. Such support members 22 not only take radial loads and reduce the wobble of the shaft 20 but also localize the vibratory action of each of the unbalanced mass members 21 upon the soil. It is suitable to use this construction when the structure and the density of soil vary in depth.

The tool of the invention may also be constructed as shown in FIG. 14 of the accompanying drawings.

In accordance with this modification the body 1 comprises a sizing part 3 and two soil compacting parts, namely the front one designated 1*a* (from the sizing part 3 to the tool tip 5) and the back one designated 1*b* (from the sizing part 3 to the boring rod 2).

The soil compaction parts 1*a* and 1*b* of the body 1 are substantially similar and have much in common with the soil compaction part hereinbefore discussed in detail in connection with the first tool form (FIG. 1). The present modification also has coaxial body portions defined by cylindrical surfaces and of step-down radii—of the front part 1*a* those are body portions 4*a* having radii diminishing toward the tool tip 5 while those of the back part 1*b* designated. 4*b* having radii diminishing toward the boring rod 2. Both the front 1*a* and the back 1*b* parts have transition portions 7*a* and 7*b* as well as the ridge members 8*a* and 8*b* respectively.

Apart from the front part 1*a*, the back part 1*b* enables the tool of the present modification to be used in practicing variously modified versions of the method according to the invention.

Figures 15A, 15B, 15C, 15D:
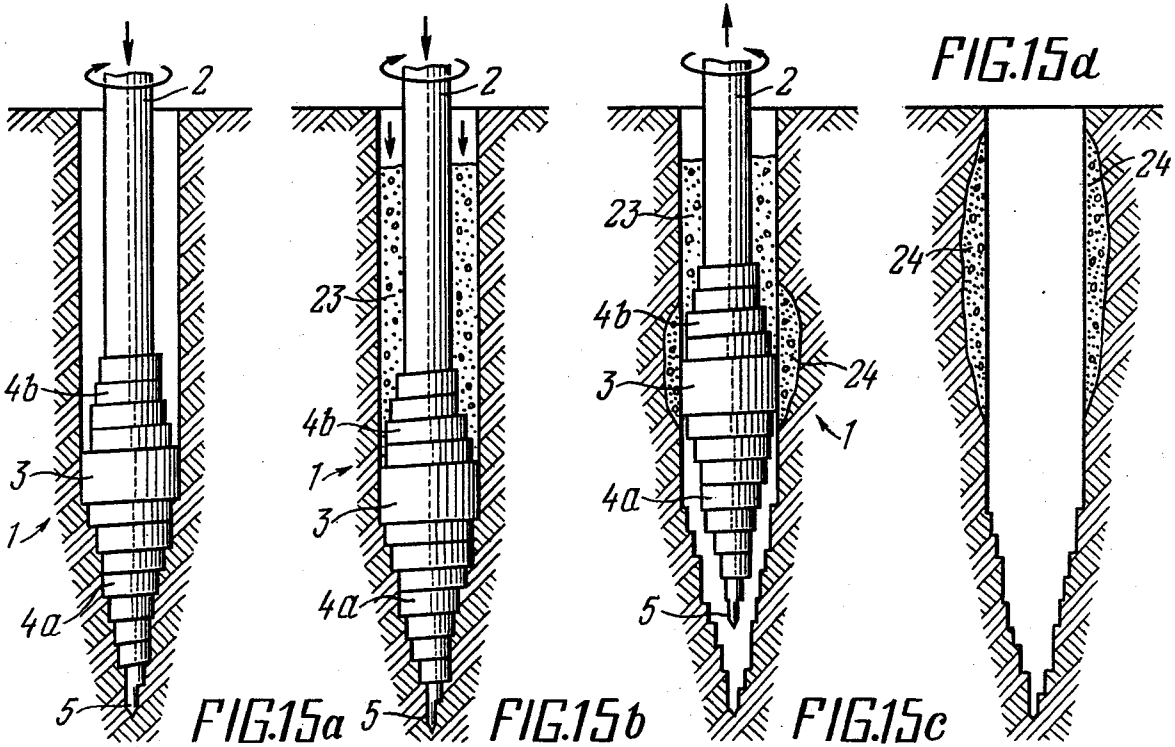

Thus, according to one of the modifications of the method, the tool is driven into soil to a predetermined depth (FIG. 15*a*) to thereafter supply a consolidating material 23 (FIG. 15*b*) through the mouth and into the hole formed and then the tool is withdrawn (FIG. 15*c*). As the tool is withdrawn (FIG. 15*c*) the back part 1*b* forces the consolidating material 25 into the wall of the hole to form a consolidating casing 24 circumferentially of the hole. The consolidating material 23 keeps the wall of the hole from falling down as the hole is being formed and considerably improves the load-carrying capacity of the cast-in-place pile that is to be formed there.

As can be seen in FIG. 15*d* the hole that has been formed has a consolidating casing 24. This hole may be used not only for forming a cast-in-place pile but for other purposes too, for example it may be used as a well of various applications. The consolidating material may comprise concrete mixture, sand, slag, sand-and-cement slurry, organic astringent pastes, soil mixtures and other materials.

It is to be appreciated that the wall of a hole may be consolidated both along the length and at any location as desired. Thus, according to a modified method, the consolidating material is supplied batchwise to fill a length of the hole, e.g. from 2 to 3 m. The batch-wise supply of the consolidating material is essentially useful in decreasing the material consumption. Also, the batchwise supply may be used for controlling the load on the tool both in driving in the withdrawing it from the soil.

According to an alternative mode of practicing the method a consolidating material may be supplied simultaneously with driving the tool into soil and then be pressed into the wall of the hole in the manner previously disclosed as the tool is withdrawn following the hole formation.

The choice of the method variation depends on the conditions of the pile formation, the desired labor efficiency, on the hole dimensions, the composition of the consolidating material and some other factors.

The tool of the invention may be constructed as shown in FIGS. 16 and 17. According to the instant modification (FIG. 16) the tool comprises, apart from the main body 1 of a similar construction as that shown in FIG. 1, substantially the same additional body 25 arranged coaxially with the former and connected therewith by a hollow connector 26.

This additional body 25 has an axial bore 27 communicating with the hollow connector 26 and a portion 28 for connecting a tubular boring rod 2. In such a connector like the present one designated 26 there are lateral openings 29 (FIG. 17). Due to such a system of communicating passages the hole being formed may be supplied with a hardenable fluid such as the consolidating material specified above.

This tool is driven into soil (FIG. 18*a*) in the same way as has been disclosed for the first tool construction (FIG. 1). As the tool is driven in, a consolidating material 23 is supplied into the hole being formed through the boring rod 2, the bore 27 and the openings 29 in the connector 26 to fill the space between the main body 1 and the additional body 25. During the hole formation the consolidating material 23 is pressed into the wall of the hole by the front soil compacting part 25*a* of the additional body 25 to produce a consolidating casing 24 inside the hole.

Figure 18B:
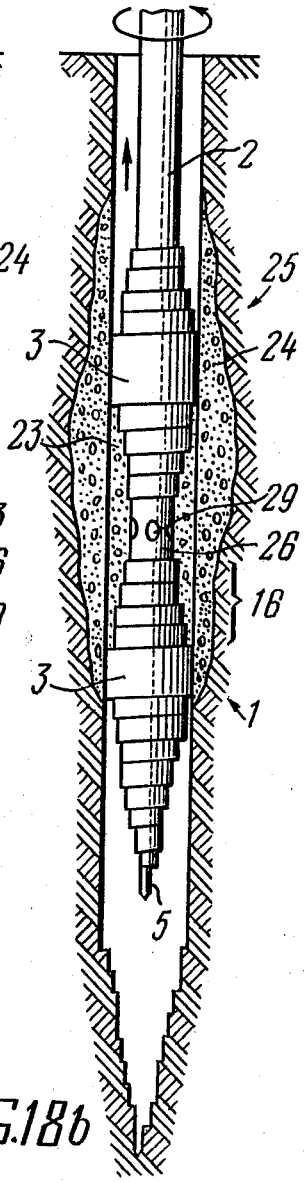

After the tool has been driven into soil to a desired depth a withdrawal operation begins (FIG. 18*b*). Now the consolidating material 23 is pressed into the wall of the hole by the back soil compaction part 1*b* of the main body 1 and the casing 24 grows thicker.

To sum up, the present modification of the tool is used to simultaneously compact and solidify soil both in driving the tool in and withdrawing it from the soil. This helps to increase labor productivity.

It is to the skill of the man of art that the tool of the invention may be constructed to have more than two bodies. This being the case, a single-layer casing as well as a multi-layer casing a dissimilar materials can be produced. For the latter case it is imperative that one consolidating material be supplied when the hole is formed and a different material when the tool is withdrawn.

The tool may have more than one axial bore, each conducting a different consolidating material.

In order to cast piles in the holes formed by the method of the invention the most suitable tool is that shown in FIGS. 19 through 24. According to this modification (FIG. 19) the body 1 of the tool comprises two parts 30 and 31 in one arrangement and a further part 32 in another, this latter arrangement being shown in the drawings as more versatile.

Each of the body parts comprises body portions 4 having step-down radii hereinbefore discussed in more detail. The first part 30 is attached to a tubular boring rod 2 at the larger side thereof (uppermost in the drawing) and has a through axial bore 33, and at the smaller side (lowermost in the drawing) it has an end face similar to the step 6 provided between the adjacent body portions 4 of the second part 31 of the body 1.

The second part 31 has a tool tip 5 and is received in the bore 33 of the first part for axial movement therealong. Also, this part has an axial bore 34 with lateral openings 35 for admitting a hardenable fluid, for example a concrete mixture, through the tool and into the hole.

In the walls of the axial bore 33 of the first part 30 are provided longitudinal grooves 36 and on the outside portion of the second part 31 there are projections 37 received in the grooves for movement therein. Such arrangement makes possible a simultaneous rotation of the first 30 and the second 31 parts on the boring rod 2 as the latter rotates in normal operation.

The third part 32 of the body 1 is similar to the first part 30 but turned with its portions 4 back, i.e. its tapering is in the direction of withdrawal of the tool from the soil. This part 32 is slipped over the tubular boring rod 2 for sliding motion therealong and has a part 3 of a greater radius serving as a sizing part and provided with a skirt 38 extending towards the first part 30 of the body 1. This being the case, a stop 39 is provided on the boring rod 2 for limiting the motion of the third part 32 of the body 1 along the boring rod 2 as the tool is being driven into soil. The skirt 38 has an end face which is congruent with the step 6 between the coaxial portions 4 of the first part 30 of the body 1.

At the place where the first part 30 of the body 1 is attached to the boring rod 2 the latter has a radial surface 40 (see FIG. 21) which in this case is made on the flange 41 (FIG. 19) of boring rod 2 and has an engaging means formed, in particular, by projections 42. The third part has an opposite surface 43 having a corresponding engaging means 44. Such a construction ensures the engagement between the projections 42 and the projections 44 (see FIG. 22) and thereby preclude turning of the third part 32 of the body 1 with respect to the first 30 and the second 31 parts, which prevents loozening of the hole wall being compacted. It is to be noted that the skirt 38 is sufficiently extending in the axial direction so as to provide an enclosed fluid discharge zone for the fluid flowing from the outlet openings 35 in the second part 31 of the body 1, as shown in FIGS. 22 and 23.

Making a cast-in-place pile with the aid of the above modification of the tool is done in the following manner. First, the tool is driven into soil as described above to make a hole 45 (see FIG. 24*a*). The arrangement of the elements of the tool at this stage is shown in FIG. 19: the second part 31 of the body 1 bears against the flange 41 of the boring rod 2, the third part against the stop 39, and the end face of the skirt 38 is disposed on a corresponding helix of the first part 30. Such being the case, the openings 35 of the second part 31 are overlapped by the first part 30 of the body 1.

Then (see FIG. 24*b*) through the boring rod 2, axial bore 34 and openings 35 of the second part 31 of the body 1, a concrete mixture 46 is fed into the hole 45 and simultaneously therewith the tool is being withdrawn from the hole 45 which is in the upper zone may that time get filled with mud. Under the pressure of the concrete mixture 46 and by gravity the second part 31 of the body 1 moves with respect to the first part 30 into the position shown in FIG. 22 with the result that the openings get open and the concrete mixture 46 flows into the hole 45 thus forming the cast-in-place pile 47. Since the skirt 38 by that time circumferentially prevents the concrete mixture from flowing out, no particles of flowing soil get thereinto, which substantially up-grades the quality of the pile produced according to the invention. In addition, the pressure of the flowing soil upon the third part 32 of the body 1 provides for a reliable engagement of the projections 42 and the projections 44 and thus prevents this part from being turned about with respect to the rod 2.

Thus, this modification of the tool makes it possible to make the hole and to fill it with concrete without replacing the equipment and without employing casings for reinforcement of the hole in unstable ground. This considerably enhances the efficiency of the pile production process.

What is claimed is:

1. A tool for forming a hole in macroporous compressible soil, comprising: a body having a sizing part, said body adapted for connection to a boring rod and having a tool tip, coaxial body portions radially defined by soil compaction surfaces having radii decreasing stepwise from the sizing part to the tool tip so that a step is formed between adjacent portions, the soil compacting surface of each body portion being a cylindrical surface defined by a generatrix of a predetermined length extending parallel to the axis of the tool and confined by two parallel helical lines having an identical helix angle and transition portions, said transition portions being radially defined by a cylindrical surface conjugating the surfaces of axially adjacent body portions, the generatrix of the surface of the transition portions having a length equal to the length of the generatrix of the cylindrical surface of said coaxial body portions to provide a smooth transition from the surface of the body portion of a larger radius to the surface of an adjacent portion of a smaller radius.

2. A tool as set forth in claim 1, wherein the adjacent transition portions are displaced in relation to each other along the cylindrical helix by an angular value not greater than 720°.

3. A tool as claimed in claim 1 having an axial cavity tapering toward the tip and a vibrator having a rotary drive, said vibrator arranged in said cavity to cause lateral vibration, a shaft coupled with the drive and extending substantially coaxially with the axis of the tool, unbalanced members mounted on the shaft along the length thereof, said unbalanced members having different weights decreasing in the direction of the taper of the cavity in the body, supports for the shaft being provided between the unbalanced members, whereby the vibratory effect of each of the unbalanced members on the soil is localized.

4. A tool for forming a hole in macroporous compressible soil, comprising: a body having a sizing part, said body adapted for connection to a boring rod and having a tool tip, coaxial body portions radially defined by cylindrical compacting surfaces having radii decreasing stepwise from the sizing part to the tool tip so that a step is formed between adjacent portions, the cylindrical surfaces adjacent the steps being provided with ridge members disposed along the helical line, the radial extent of the ridge members not exceeding the radial extent of the step of an adjacent body portion having a larger radius, the soil compacting surface of each body portion being a cylindrical surface defined by a generatrix of a predetermined length extending parallel to the axis of the tool and confined by two parallel helical lines having an identical helix angle and transition portions, said transition portions being radially defined by a cylindrical surface conjugating the surfaces of axially adjacent body portions, the generatrix of the surface of the transition portions having a length equal to the length of the generatrix of the cylindrical surface of said coaxial body portions and being parallel to the axis of the tool and uniformly approaching said axis to provide a smooth transition from the surface of a body portion of a larger radius to the surface of an adjacent portion of a smaller radius.

5. A tool for forming a hole in macroporous compressible soil, comprising: a body having a sizing part, said body adapted for connection to a boring rod and having a tool tip, coaxial body portions radially defined by cylindrical compacting surfaces having radii decreasing stepwise from the sizing part to the tool tip so that a step is formed between adjacent portions, the soil compacting surface of each body portion being a cylindrical surface defined by a generatrix of a predetermined length extending parallel to the axis of the tool and confined by two parallel helical lines having an identical helix angle and transition portions, said transition portions being a roller having end faces and being rotatable about an axis disposed at an angle to the tool axis, said angle being equal to the helix angle of the helical lines confining the cylindrical surfaces of adjacent body portions so that each helical line extends in the plane of a respective end face roller to provide a smooth transition from the surface of a body portion of a larger radius to the surface of an adjacent body portion of a smaller radius.

6. A tool for forming a hole in macroporous compressible soil, comprising: a body having a sizing part, said body adapted for connection to a boring rod and having a tool tip, first coaxial body portions having radii decreasing stepwise from the sizing part to the tip and second coaxial body portions having radii decreasing stepwise from the sizing part to the point for attachment of the boring rod, the portions having stepwise decreasing radii being radially confined by cylindrical surfaces defined by a generatrix of a predetermined length extending parallel to the axis of the tool and confined by two parallel helical lines having an identical helix angle, said surfaces being successively conjugated with one another by transition portions having a cylindrical surface whose generatrix is parallel to the axis of the tool and uniformly approaches said axis to provide a smooth transition from the surface of a body portion of a larger radius to the surface of an adjacent portion of a smaller radius.

7. A tool as claimed in claim 6, comprising: a further body coaxial with said body, said further body having an axial bore for passage of a hardenable medium, a sizing part and coaxial body portions having radii decreasing stepwise from the sizing part, the coaxial body portions being radially defined by cylindrical surfaces defined by a generatrix of a predetermined length extending parallel to the axis of the tool and confined by two helical lines having an identical helix angle, said surfaces being successively conjugated with one another by transition portions having a cylindrical surface whose generatrix is parallel to the axis of the tool and uniformly approaches said axis to provide a smooth transition from the surface of a portion of a larger radius to the surface of an adjacent portion of a smaller radius, said further body being rigidly coupled at one end with said body of the tool by a hollow reducing member having openings which communicate with the hole for the passage of a hardenable fluid into the hole, and having at the other end a means for connection to a tubular boring rod through which the hardenable fluid flows into the hollow reducing member and further through the openings in the reducing member into the hole.

8. A tool for forming a pile in macroporous compressible soil, comprising: a body having a sizing part, said body adapted for connection to a boring rod and having a tool tip, said body comprising at least two separate coaxial body portions wherein at least one of said coaxial body portions is radially defind by soil compacting surfaces having radii decreasing stepwise from said sizing part to the tool tip, a first of said at least two portions having an axial bore and being attached at the end having a larger radius, an end face of the shape of a step between adjacent body portions and a second of at least two coaxial body portions carrying the tip and being adapted for axial movement into the axial bore of a coaxial body portion, said second of at least two coaxial body portions have an axial bore and openings whereby a hardenable fluid supplied through said tubular boring rod can be discharged in a hole formed by the tool to form a pile, the walls of the axial bore of said first body portion having axial grooves and said second body portion having projections on the outside thereof which are received in said axial grooves of said first body portion, said projections slide along said grooves so that when said tool is driven into the ground the second body portion is moved into the first body portion and the openings are closed by a part of the first body portion and when the tool is extracted from the hole, the second body portion extends from the first body portion and the openings are uncovered, whereby the hardenable fluid can flow therefrom to form a molded in-place pile.

9. A tool as claimed in claim 6, comprising a third body portion slidably fitted on the tubular boring rod having a cylindrical surface which serves as a sizing part, said third body portion being provided with a skirt extending toward the first body portion and having an end face identical in shape to the step between the adjacent portions, a radial surface with engaging means being provided at the point where the first part of the body is attached to the boring rod, and the third part of the body being provided with an opposite surface having a corresponding engaging means, whereby the turning of the first and second body portions relative to the third body portion is prevented when the tool is extracted from the hole, the skirt having an axial length sufficient to restrict the discharge zone of the hardenable fluid flowing out of the discharge openings in the second part of the body when the tool is removed from the hole, and the boring rod being provided with a stop to limit the travel of the third part of the body along the boring rod when the tool is driven into the ground, thereby setting the end face of the skirt on a respective helical line.

* * * * *